US006912802B2

(12) United States Patent
Cooper

(10) Patent No.: US 6,912,802 B2
(45) Date of Patent: Jul. 5, 2005

(54) GOLF ALIGNMENT SYSTEM AND METHOD

(75) Inventor: Michael Thomas Cooper, 8852 155th Pl. North, Palm Beach Gardens, FL (US) 33418

(73) Assignee: Michael Thomas Cooper, Palm Beach Gardens, FL (US)

( * ) Notice: Subject to any disclaimer, the term of this patent is extended or adjusted under 35 U.S.C. 154(b) by 0 days.

(21) Appl. No.: 10/645,946

(22) Filed: Aug. 22, 2003

(65) Prior Publication Data

US 2004/0159019 A1 Aug. 19, 2004

Related U.S. Application Data

(60) Provisional application No. 60/447,363, filed on Feb. 14, 2003.

(51) Int. Cl.[7] ..... A43B 5/00

(52) U.S. Cl. ..... 36/127; 36/1; 36/114; 36/132; 36/136

(58) Field of Search ..... 36/127, 1, 114, 36/132, 136, 45; 473/270, 278, 218

(56) References Cited

U.S. PATENT DOCUMENTS

| | | | | | |
|---|---|---|---|---|---|
| 2,503,586 | A | | 4/1950 | Miller | |
| 3,420,529 | A | * | 1/1969 | Hennigan et al. | 473/218 |
| 3,641,687 | A | * | 2/1972 | Hibbard et al. | 36/130 |
| 4,113,258 | A | | 9/1978 | Midana | |
| 4,164,352 | A | * | 8/1979 | O'Brien | 473/218 |
| 4,199,881 | A | | 4/1980 | Francis | |
| 4,354,319 | A | | 10/1982 | Block et al. | |
| 4,563,010 | A | * | 1/1986 | McDorman et al. | 473/267 |
| 4,756,098 | A | | 7/1988 | Boggia | |
| 4,937,954 | A | * | 7/1990 | Clement | 36/127 |
| 5,171,017 | A | | 12/1992 | Betancourt | |
| 5,306,011 | A | | 4/1994 | Perry | |
| 5,381,614 | A | | 1/1995 | Goldstein | |
| 5,947,832 | A | * | 9/1999 | Gagne | 473/217 |
| 6,077,169 | A | * | 6/2000 | Florian | 473/278 |
| 6,739,980 | B2 | * | 5/2004 | Scott et al. | 473/200 |
| 6,743,111 | B2 | * | 6/2004 | Mindlin | 473/218 |

* cited by examiner

*Primary Examiner*—M. D. Patterson
(74) *Attorney, Agent, or Firm*—Christopher & Weisberg, P.A.

(57) ABSTRACT

A golf alignment system and method that allows a golfer to properly align his or her feet in relation to the already positioned golf club prior to attempting a shot. The invention comprises one or more substantially horizontal alignment stripes disposed upon a pair of shoes worn by a golfer. The alignment stripes may be of any color or material provided they are visually discernable from the rest of the shoe. The present invention uses aligned stripes skewed at a slight angle, offset from the longitudinal axis of the golfer's shoes. Because a human's back or heel portion of the foot is narrower than the front portion, adjacent horizontally disposed alignment stripes on each individual shoe, when brought together, would not result in a series of horizontal lines. However, when utilizing the present invention at the beginning of the alignment process before the golfer actually strikes the ball, the golfer brings his or her feet together or very close to each other. In this position, the front portions of the golfer's feet are slightly splayed out due to the wider front portion of the feet and narrower heel portion of the feet, such that a series of parallel horizontal lines are formed. The golfer may then glance down at a vertical alignment channel that is created by the newly formed sets of parallel horizontal lines, and use it as a guide in order to align his or her feet in respect to the putter face and original target line, which in turn then aids the golfer in aligning the rest of his or her body for a proper golf shot.

19 Claims, 6 Drawing Sheets

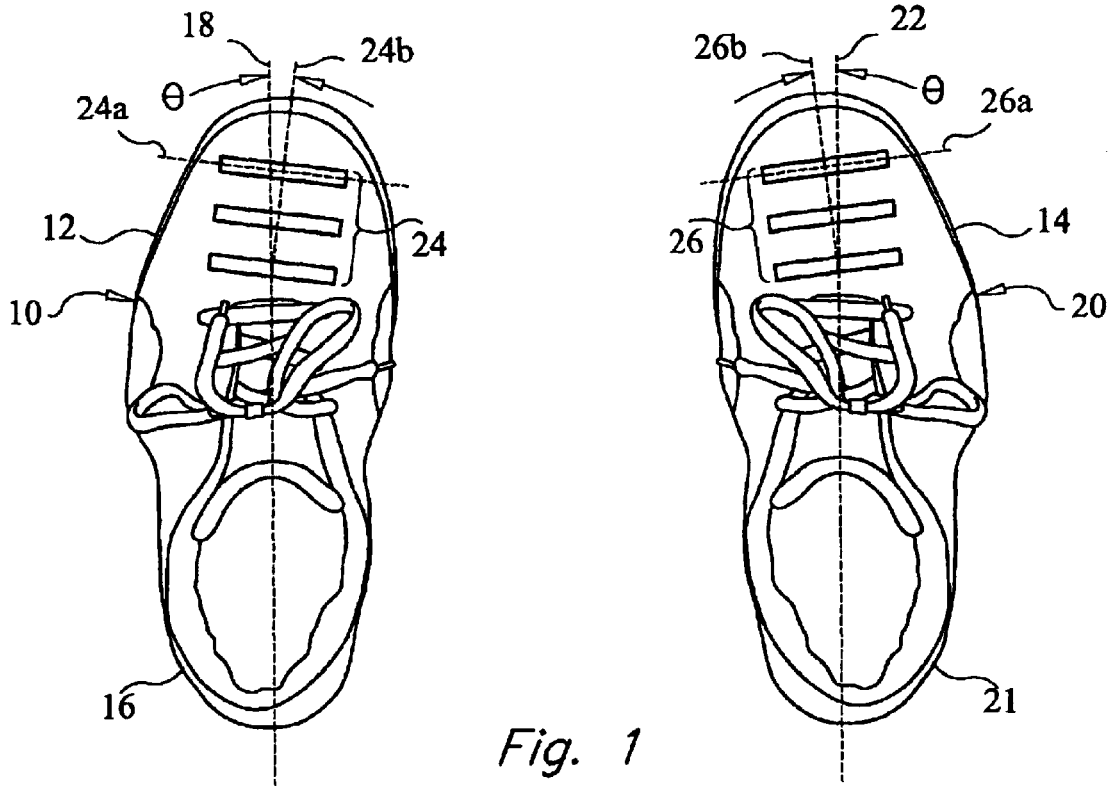
Fig. 1
Fig. 2
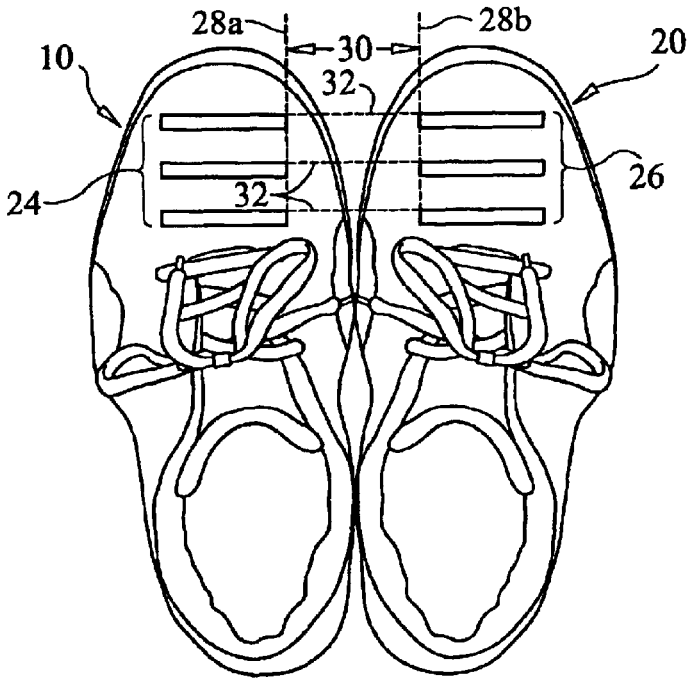

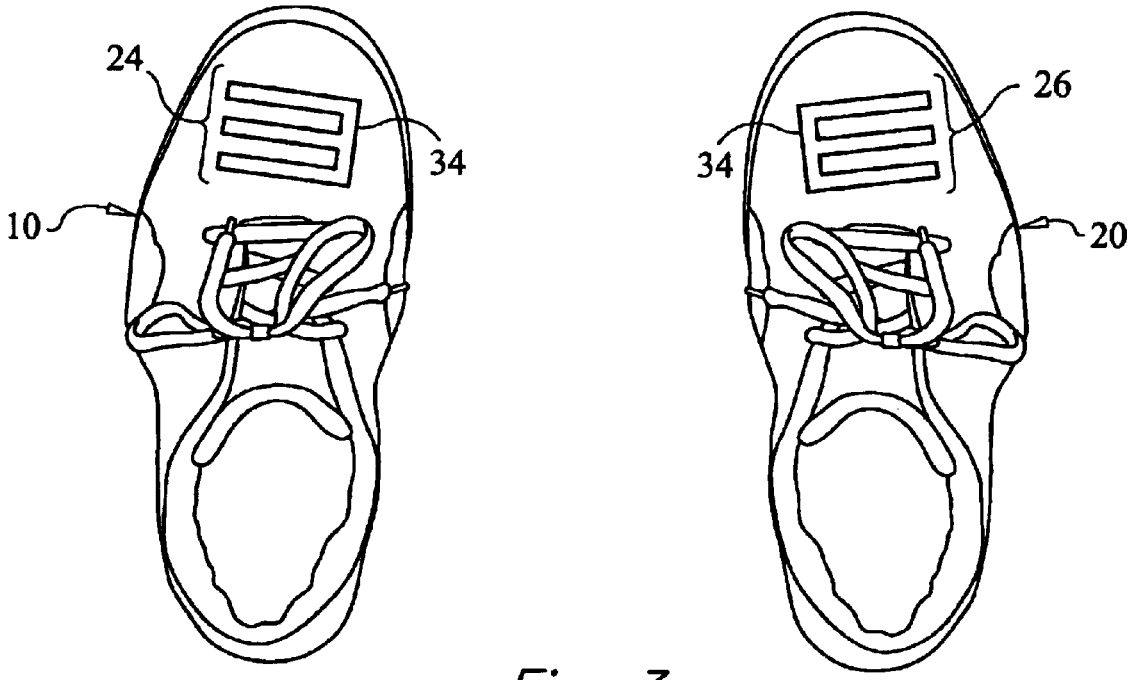
Fig. 3
Fig. 4
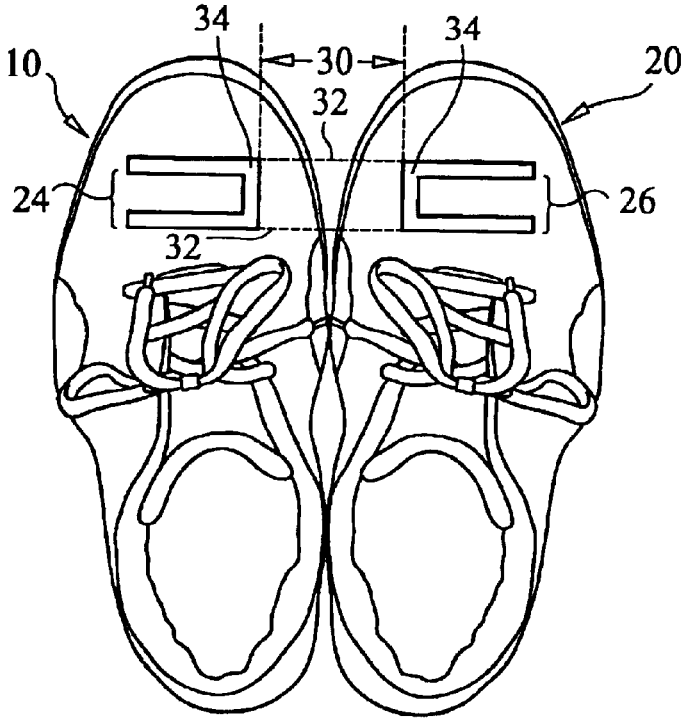

GOLF ALIGNMENT SYSTEM AND METHOD

CROSS-REFERENCE TO RELATED APPLICATION

This application is related to and claims priority to U.S. Provisional Patent Application Ser. No. 60/447,363 filed Feb. 14, 2003, entitled GOLF ALIGNMENT SYSTEM AND METHOD, the entirety of which is incorporated herein by reference.

STATEMENT REGARDING FEDERALLY SPONSORED RESEARCH OR DEVELOPMENT n/a

FIELD OF THE INVENTION

The present invention relates to a golf device and more particularly to a golfing system and method that assists a golfer in aligning his or her feet and body in order to properly and accurately strike a golf ball without the need for placing alignment objects on the golf course.

BACKGROUND OF THE INVENTION

Golf, particularly in the area of putting, is a deceptively difficult sport. A golfer requires concentration, hand-eye coordination and determination to be successful. Various golf aides are available that enable the golfer to best utilize his or her skills and to assist in providing guides in order to make the art of putting easier. However, golf is not without its strict rules. For example, no guiding mechanisms are allowed to be placed on the golf course that would unfairly assist in providing a direct path from the golfer to the golf hole. It is entirely up to the golfer to gauge the distance and direction from the ball to the hole and to determine exactly how and where to strike the ball in order to sink a putt.

During the set-up process of a golf shot, in particular, putting, a golfer will choose a visual target line for the path of the intended shot. This is typically done by standing or crouching behind the golf ball and transposing an imaginary target line onto the ground from behind and continuing on through in front of the ball. At this point, the golfer will then usually stand alongside the ball, in what is typically referred to as the "address position", in preparation for the ensuing stroke.

The problem that the present invention rectifies occurs at this stage. Once the golfer is in the "address position", the golfer is now positioned sideways to the chosen target line. As the golfer turns to confirm the line, his head turns at an angle thus altering the perceived line of the shot. The problem may be further compounded by the visual dominance of one eye over the other. In response to this perceived line change, a golfer will often adjust his or her body position incorrectly. In the process of putting, incremental changes in the chosen line can have negative and perhaps disastrous effects upon the outcome of the shot. To overcome this problem, the golfer may, either deliberately, or by an unrealized technical breakdown, attempt a variety of ways to manipulate the golf ball back onto the correct target line. Needless to say, this leads to an inconsistent stroke, something no golfer wants to be encumbered with.

Because the United States Golf Association (USGA), the organization governing the rules of golf in the United States, prohibits the use of any artificial measuring or alignment devices placed on the golf course, what would be beneficial is a method and apparatus that complies with the rules of golf and would allow the golfer to easily align his or her body over the ball to produce a properly aligned stroke.

While there exist other golf-alignment patents, none provide an alignment system that assist the golfer in aligning a golf shot, particularly during putting, and is activated by merely bringing the golfer's shoes together in a side-by-side manner. For example, U.S. Pat. No. 2,503,586, issued to Miller, discloses a golf shoe having indicia upon the shoe in the form of contrasting colors and/or cross-hatched lines. In Miller, the golfer aligns only the golf ball with the front shoe by lining up the ball with the intersection of lines on the golfer's front shoe. However, in Miller, the rear shoe plays no role in the alignment process. Further, Miller fails to disclose an alignment system that utilizes both shoes together and that is activated when the golfer brings his or her shoes together in a natural, side-by-side manner, an orientation normally necessary to properly strike a golf ball during putting.

U.S. Pat. No. 5,381,614 issued to Goldstein discloses golf alignment shoes that allow a golfer to achieve a proper stance prior to striking the ball. The golfer is required to move the front of his or her golf shoes outward until indicia upon the left shoe is aligned with indicia on the right shoe. At this point, the proper "Hogan" stance is achieved. However, the golfer must "eyeball" the lines on each shoe and then subjectively determine at what point to stop in order to achieve alignment and maintain the stance before striking the ball. This patent fails to disclose a system that provides alignment stripes on each shoe wherein, when the golfer simply brings his or her shoes together, preferably, so the heels and toes either touch, or are very close to each other, the alignment stripes form a vertical alignment channel and corresponding set of alignment stripes to assist the golfer in positioning his or her feet and body in order to properly strike the ball. Instead, Goldstein focuses on assisting the golfer in achieving a specific golfing stance for fairway shots only.

It is therefore desirable to provide a system and method for assisting a golfer in aligning his or her feet, body and golf club, prior to striking the ball, by utilizing a series of alignment stripes disposed on the golfer's shoes, and which is activated when the shoes are brought together.

SUMMARY OF THE INVENTION

The golf alignment system of the present invention gives a golfer an opportunity to correct the aforementioned problems in the art by aiding the golfer in aligning his or her feet with the face of the golf club prior to striking the ball. This is accomplished through a simple step-by-step procedure that utilizes one or more sets of horizontal alignment stripes disposed upon each shoe and particularly a Vertical Alignment Channel ("VAC") that is created by lining up the inner edges of these alignment stripes. By utilizing this system, nearly the entire alignment process can be performed while looking directly down (with the head and eyes level), at the feet, clubface and golf ball, as opposed to attempting to line up the shot by awkwardly skewing the head and eyes to the side.

The present invention comprises one or more alignment stripes disposed on a pair of shoes worn by a golfer. The alignment stripes may be of any color or material provided they can be distinguished from the rest of the shoe. For example, the portion of the shoe without any indicia may be white or off-white, the common color of golfing shoes, and the stripes may be black, red, or dark blue. In one embodiment, the alignment stripes may be painted or drawn on the shoes. In another embodiment, the alignment stripes may adhere to the shoes by one of any typical method such as the use of glue, tape, VELCRO® or the like. In yet another embodiment, stripes of colored leather may be sown directly onto the shoe. In yet another embodiment, the alignment stripes are formed by raised stitching or grooves. The color of the stripes and the method in which they are affixed to the golfer's shoes are not critical to the invention and may vary. The present invention encompasses alignment stripes formed by any visually discernable markings and all adhesion methods commonly know in the art.

The actual alignment of the stripes is critical to the invention. Because the feet of a human are not uniform, i.e. the back or heel portion of the foot is narrower than the front portion, alignment stripes that are horizontally disposed upon each shoe (with respect to the longitudinal axis of an individual shoe), when brought together, do not result in a series of horizontal lines extending across the shoes. Instead, due to the narrower heel portion of the feet, when the feet are brought together, the front portions of the feet are slightly splayed out, resulting in a series of stripes that are not aligned and therefore worthless to the golfer. To address this, the present invention uses precisely aligned stripes, skewed at a slight angle with respect to the longitudinal axis of the shoe, such that when the golfer's shoes are brought either together (as if the insteps and the heels were touching), or close to each other, at the beginning of the alignment process before he or she actually strikes the ball, a series of substantially parallel horizontal lines are formed. The golfer may then glance down at the Vertical Alignment Channel that has been created from the lining up of the inner edges of the now horizontal stripes, and use this visual alignment grid as a guide in order to align his or her feet with respect to the putter face and original target line, which in turn obviously influences the alignment of the rest of the body.

According to an aspect of the present invention, a golf shot alignment system is provided. The system comprises a left and a right shoe, each having a longitudinal axis wherein each shoe includes alignment indicia disposed upon an upper surface thereof, such that when the left and the right shoe are positioned proximate each other, the alignment indicia form both a vertical and horizontal alignment grid to assist a golfer in alignment of his or her feet in preparation for a properly aligned golf shot.

According to another aspect of the present invention, a pair of golf shoes used to assist a golfer in aligning his or her body before striking a golf ball is provided. The left and the right shoe each have a longitudinal axis wherein each shoe includes alignment indicia disposed upon an upper surface thereof. The alignment indicia are comprised of at least one alignment stripe, each alignment stripe having a transverse axis offset from the longitudinal axis of the shoe upon which it is disposed such that when the left and the right shoe are positioned proximate each other, the inner edges of the alignment stripes on the left shoe become substantially parallel to the inner edges of the alignment stripes on the right shoe. This is due to a wider width of a human's front foot region and a narrower width of a human's rear foot region. The result is the creation of a virtual vertical alignment channel extending forward from the aligned inner edges of the alignment stripes in order to assist the golfer in alignment of his or her feet in preparation for a properly aligned golf shot.

In yet another aspect of the invention, a method for assisting a golfer in preparing for a golf shot is provided. The method comprises the steps of positioning the golfer's left and right shoes, wherein each of the golfer's shoes have a longitudinal axis and alignment indicia disposed upon an upper surface of each said shoe. The alignment indicia are comprised of at least one alignment stripe, each alignment stripe having a transverse axis offset from the longitudinal axis of the shoe upon which it is disposed. The golfer then aligns his or her shoes such that when the left and the right shoe are positioned proximate each other, the inner edges of the alignment stripes on the left shoe become substantially parallel to the inner edges of the alignment stripes on the right shoe due to a wider width of a human's front foot region and a narrower width of a human's rear foot region. The result is the creation of a virtual vertical alignment channel extending forward from the aligned inner edges of the alignment stripes in order to assist the golfer in alignment of his or her feet in preparation for a properly aligned golf shot.

In still another aspect of the present invention, a method for assisting a golfer in preparing for a golf shot is provided. The method for comprises the steps of positioning a golfer's left and right shoes in a first position wherein the golfer's feet are in a pre-shot orientation. Each of the golfer's shoes have a longitudinal axis, wherein each said shoe includes alignment indicia disposed upon an upper surface thereof. The alignment indicia are comprised of at least one alignment stripe each having a transverse axis offset from the longitudinal axis of the shoe upon which it is disposed. The golfer then moves his or her feet together resulting in a second position wherein the golfer's shoes are proximate each other such that the inner edges of the alignment stripes on the left shoe become substantially parallel to the inner edges of the alignment stripes on the right shoe due to a wider width of a human's front foot region and a narrower width of a human's rear foot region. This creates a virtual vertical alignment channel and corresponding set of alignment stripes. In essence, a completely visual, vertical and horizontal alignment grid is used to assist the golfer in aligning his or her feet substantially parallel to an originally chosen target line.

By utilizing the present invention, the golfer may now properly position his or her feet by aligning the Vertical Alignment Channel (VAC) parallel to the already positioned clubface. This, in turn, aligns the horizontal alignment stripes parallel to the originally chosen target line.

BRIEF DESCRIPTION OF THE DRAWINGS

A more complete understanding of the present invention, and the attendant advantages and features thereof, will be more readily understood by reference to the following detailed description when considered in conjunction with the accompanying drawings, wherein like designations refer to like elements, and wherein:

FIG. 1 is a top view of a pair of golf shoes utilizing the alignment system of the present invention prior to the activation of the system wherein the golfer's shoes are separated;

FIG. 2 is a top view of a pair of golf shoes utilizing the alignment system of the present invention after the system has been activated wherein the golfer's shoes are close together;

FIG. 3 is a top view of an alternate embodiment of the present invention wherein each shoe utilizes a vertical alignment stripe connecting three horizontally-disposed alignment stripes;

FIG. 4 is a top view an alternate embodiment of the present invention wherein each shoe utilizes a vertical alignment stripe connecting two horizontally-disposed alignment stripes;

DETAILED DESCRIPTION OF THE INVENTION

Figure 5:
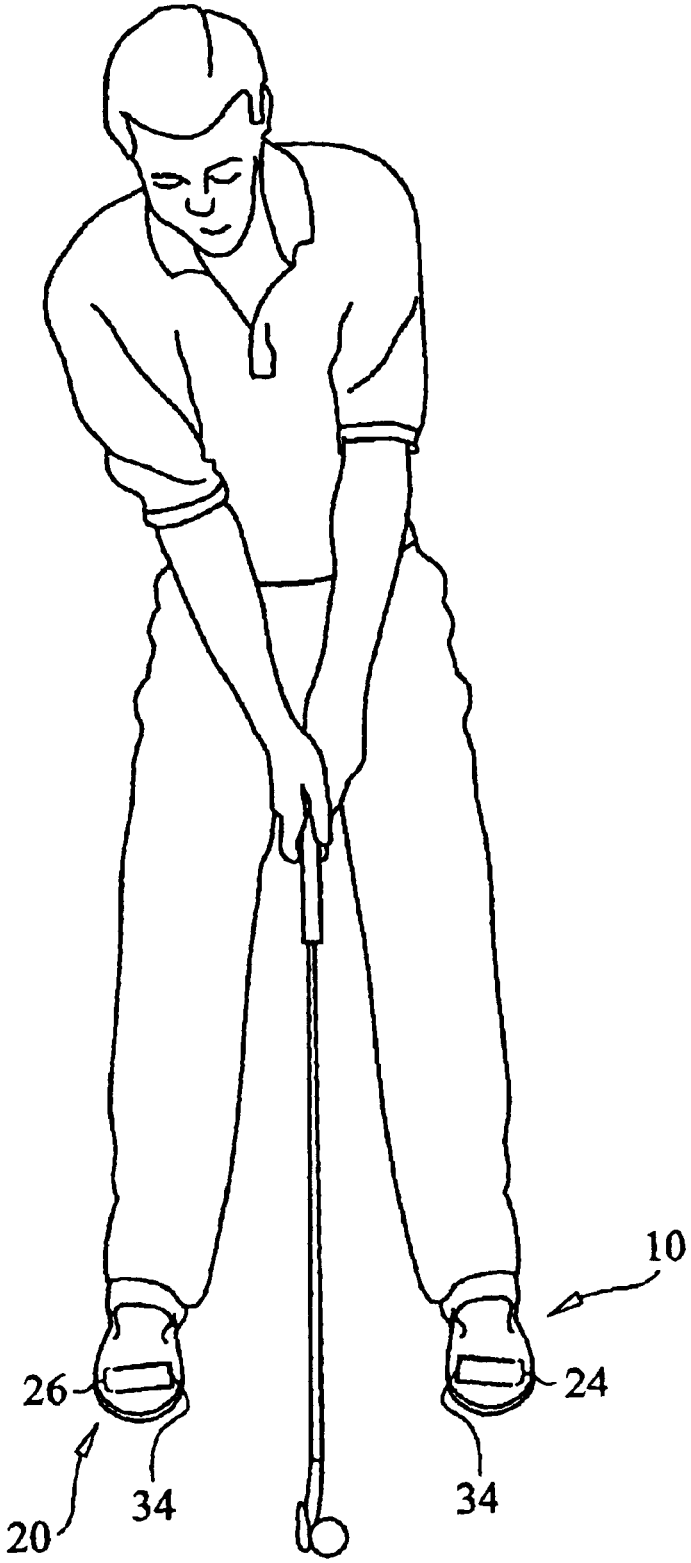
FIG. 5 is a front view of a golfer wearing the golf shoes of the present invention approaching a ball prior to putting.

The present invention is a system and method used to assist a golfer in aligning his or her feet, body and golf club before striking the ball. The system is comprised of indicia disposed upon the golfer's shoes in such a manner that when the shoes are brought together in a side-by-side fashion, a common procedure prior to putting, the result is a visual vertical and horizontal alignment grid that helps the golfer align his or her body and golf club to thereby assist in striking the ball along the chosen target line.

Referring to FIG. 1, a pair of golf shoes incorporating the alignment indicia of the present invention, is shown. Left shoe 10 and right shoe 20 comprise a pair of shoes normally used by a golfer on a golf course. The shoes include front regions 12 and 14, and rear regions 16 and 21. The shape of a human's foot is unique in that the width of the front portion is wider than the width of the rear portion. This can be seen clearly in FIG. 1. Shoe 10 includes a longitudinal axis 18 running lengthwise through the shoe, from rear region 16 to front region 12. Likewise, shoe 20 includes a longitudinal axis 22 running lengthwise through the shoe, from rear region 21 to front region 14.

Shoes 10 and 20 further include a series of alignment stripes 24 and 26 disposed upon the upper front surface of each shoe. Stripes 24 and 26 are substantially rectangular in shape and each are comprised of a longitudinal axis 24*a*, 26*a* and a transverse axis 24*b*, 26*b*. As can be seen from FIG. 1, the alignment stripes 24 and 26 are aligned in a manner offset from the corresponding longitudinal axis 18, 22 of each shoe such that the transverse axes 24*b* of alignment stripes 24 are offset from the longitudinal axis 18 of shoe 10 by an angle θ. Likewise, the transverse axes 26*b* of alignment stripes 26 are offset from the longitudinal axis 22 of shoe 20 by an angle θ.

Angle θ can vary depending upon the width of the shoes. For example, shoes with little difference in the toe and heel region widths may have an angle θ of as little as approximately 10 degrees or less, while shoes with a large disparity in heel and toe width may have an angle θ larger than 10 degrees. Generally, shoes that have a wider front region 12 and 14, for example, may require a larger angle θ. In other words, if front portions 12 and 14 were wider, when the golfer's feet came together as shown in FIG. 2., the front portions of each shoe may be splayed out at a greater angle due to the wider dimensions of the front regions of the shoes. Therefore, in order for alignment stripes 24 and 26 to properly line up when the shoes are in the position shown in FIG. 2, the stripes may have to be disposed upon the shoes at a greater angle θ. Although shoes 10 and 20 shown in FIG. 1 include three alignment stripes, the present invention is not limited to the number of horizontally-disposed alignment stripes. One or more alignment stripes may be disposed upon each shoe. However, the stripes need not be of a rectangular shape. The alignment stripes must however be aligned beneath each other in such a manner that when the shoes are brought together, the inner edges of the alignment stripes of one shoe are substantially parallel to the inner edges of the alignment stripes of the other shoe thus forming a Vertical Alignment Channel (VAC) extending forward and towards the golf green. In other words, if more than one alignment stripe is used on a shoe, the stripes (when the shoes are brought together or very close to each other) must line up in such a fashion that the inner edges of alignment stripes on one shoe form an imaginary vertical line that is substantially parallel with an imaginary vertical line formed by the corresponding inner edges of the alignment stripes upon the other shoe. This is critical to the formation of the Vertical Alignment Channel (VAC) described in greater detail below.

Alignment stripes 24, 26 may be disposed upon shoes 10, 20 in a variety of ways. Stripes 24, 26 may be stitched onto each shoe, affixed to the shoe via adhering means, such as glue, VELCRO® or other common adhesive means commonly known in the art, painted upon the shoes, or formed as an integral part of the shoes. The stripes themselves may be comprised of any material that can be affixed to golf shoes either permanently or temporarily. Felt, plastic, waterproof material, stitching and sown-on leather are just a few examples of material that can be used. Further, the stripes 24 and 26 may be formed of a color that is in contrast to the color of the shoes in order for the golfer to easily detect the stripes. Golf shoes are typically white, so the alignment stripes may be black or another dark color so that they may be easily noticeable. Alternatively, the stripes may be comprised of raised stitching, recessed grooves, or virtually any other type of visually perceptible markings.

The present invention is not limited to a specific number of alignment stripes 24, 26. Further, as described above, the angle of the alignment stripes may be altered to accommodate different styles and widths of golf shoes. Some golf shoe manufacturers make wider soled shoes, which would affect the angle of orientation of the stripes. The alignment stripes utilized in the present invention may be comprised of virtually any type of material that can adhere to the tops of golf shoes. Further, as mentioned, the alignment stripes may be painted or drawn on the shoes or, the shoes may be manufactured with the alignment stripes as an integral part of the shoes, or the alignment stripes may be comprised of raised stitching or recessed grooves within the shoe.

In FIG. 1, shoes 10 and 20 are positioned in a wide-apart, shoulders width orientation, which is typically taken by a golfer approaching a golf ball. In this first position, with the golfer's feet positioned directly forward, i.e., not in a natural, splayed-out stance, the alignment stripes 24, 26 cannot be utilized as an alignment guide since their transverse axis 24*b*, 26*b* are offset from the natural longitudinal axes 18, 22 of shoes 10, 20. Therefore, if the golfer were to look down at the shoes at this point, the golfer would see a series of skewed stripes at an angle offset from the lengthwise axis of each shoe. FIG. 2, however, illustrates shoes 10, 20 after the golfer has moved his or her feet together, in a side-by-side, second position. This is normally done prior to a putt, to allow the golfer to properly align his or her body and golf clubface. Some golfers may even keep their feet in this orientation during the putt. Although FIG. 2 illustrates shoe 10 touching shoe 20 at both the heel and the toe regions, the shoes need not be actually touching at these regions. The shoes could be touching at the toe regions and not touching although very close to each other at the heel regions. Likewise, the heel regions could be touching while the toe regions are very close to each other, but not touching. Finally, the shoes may not be touching at all, but are positioned very close to each other. The amount of space between the shoes actually depends upon the golfer's eyesight and experience in using the present invention since the golfer must perceive a virtual continuous horizontal line from alignment stripes 24 on the left shoe 10 to alignment stripes 26 on the right shoe 20. Further, the golfer must perceive a virtual continuous Vertical Alignment Channel 30 formed by the alignment of the inner edges of alignment stripes 24 on shoe 10, referred to as 28*a*, and the corresponding alignment of the edges of alignment stripes 26 on shoe 20, referred to as 28*b*, extending forward onto the golf green. However, by placing the shoes in such a fashion so that the heels and toes touch, a natural guide is presented to the golfer in the form of a vertical and horizontal visual alignment grid. In this fashion, the golfer merely brings the heel and toe regions of the shoes together so that they touch, or so that they are very close to each other and the alignment stripes, appearing offset in the approach position shown in FIG. 1, now form both vertical and horizontal parallel guidelines to assist the golfer in aligning his or her feet and body in preparation for the ensuing golf shot.

The foundation and proper use of the golf alignment system of the present invention is centered around the Vertical Alignment Channel ("VAC") 30. VAC 30 shown in FIG. 2 is a visual reference channel formed when the user's shoes are placed close together or when they touch, as described above. Virtual vertical lines run up and down the inner edges of the aligned horizontal stripes in a north/south or vertical direction. Although in this embodiment (shown in FIG. 2) of the invention there are no actual lines marked, the channel appears due to the visually discernable color or material contrast of the alignment stripes 24 and 26, which are now directly below one another on each shoe. VAC 30 is formed only when the shoes are in a natural, side-by-side position, i.e. when the heel regions 16 and 21 and the front regions 12 and 14 of the shoes are very close to each other or touching in a side-by-side orientation. This is critical for several reasons. First, a consistent initial reference point is provided. Anybody, regardless of the size of their shoe or the shape or length of their legs, can put their feet together. Second, it provides the golfer an opportunity to align VAC 30 parallel with the golf clubface. Finally, once this position is achieved, the golfer can now be confident that the newly formed horizontal alignment stripes also provide a virtual horizontal guideline stretching across and between the shoes that is indeed parallel to the chosen target line.

It is important to note that the alignment system of the present invention does not require that the feet of the golfer must touch. Since a golfer typically places his or her feet close to each other while preparing to strike the ball, rather than actually touching their feet, the alignment system can be utilized and the VAC 30 can be formed by merely placing the shoes close to each other in a side-by-side manner, thereby mimicking the position that the shoes take as if they were actually touching each other in a side-by-side manner.

At this point in the alignment process, the golfer can turn his/her head as often as desired. The golfer's feet are in a properly aligned position. This now allows the golfer to reinforce the target line utilizing the parallel relationship of the horizontal alignment stripes to the chosen target line, spread his or her feet if desired, and take some practice strokes knowing that the clubface can be returned to the correct position by simply realigning the clubface parallel to the now established Vertical Alignment Channel 30. The arrangement of the alignment stripes 24 and 26 in a horizontal position also serves as a guide for the club head, particularly during putting, as the horizontal lines serve as a visual reminder of the correct stroke path of the putter head, i.e., straight back and straight forward. A series of horizontal guidelines 32 are shown in FIGS. 2 and 4. Here, a set of virtual horizontal lines extend between the shoes, as a natural extension of the top edge of all the alignment stripes on each shoe. The golfer can then mimic this virtual horizontal guide by swinging the golf club along an adjacent parallel horizontal plane when striking the ball.

The Vertical Alignment Channel 30 also affords the golfer a visual checkpoint for the putter face at contact. It can be seen during contact whether the putter face meets the ball square (parallel to Vertical Alignment Channel 30) or off center (i.e. "closed" or "open"), resulting in a "hooked" or a "blocked" putt, respectively. In other words, the golf alignment system of the present invention also acts as a training aid for correct putter face alignment and stroke path production. Discrete parts of the full alignment system of the present invention can be utilized individually at the golfer's discretion. For example, a beginning golfer may first need to place his or her shoes together, the heels and toes touching, utilize the vertical and horizontal alignment grid and then separate their shoes prior to striking the ball. However, as the golfer's skill in using the invention progresses, the golfer may no longer need to place his or her shoes together and, instead, may simply walk up to the ball, place his or her shoes in a comfortable position, i.e. one that mimics the close proximity stance described above, use the alignment grid to align his or her feet and body by "eyeballing" the alignment stripes, which are in a substantially parallel arrangement due to the positioning of the golfer's feet, and swing the face of the golf club through a line perpendicular to the Vertical Alignment Channel (VAC) and strike the ball.

It is important to note that the alignment stripes are not horizontally disposed upon the shoe in relation to a central lengthwise axis upon each shoe. As shown in FIG. 1, three stripes are disposed at a slight angle on the golfer's shoe. In FIG. 1, an exemplary embodiment of the invention is shown. In this illustration, a set of alignment stripes can be seen on each shoe. When the golfer's feet are separated, and the heels and toes are not touching, the lines are skewed and are not horizontal with respect to the shoe, unless they mimic the natural, splayed, side-by-side stance. Because it is generally advisable to utilize a consistent side-by-side parallel foot stance in performing a putt with the feet apart, the present invention takes into account the necessity for the golfer to place his or her feet in a side-by-side manner prior to striking the ball.

Typically, when a golfer lines up to putt a ball, the golfer first attempts to create a visual path in his mind's eye from the ball to the hole by standing or crouching behind the ball. The golfer then steps around into a sideways position, or an "address position". When one's feet are brought together, it is always the case that the front portions of the feet are slightly splayed outward since the rear or heel portion of one's feet are narrower than the front portion. Therefore, the present invention takes into account this natural difference in foot width by aligning the stripes on each shoe slightly askew, as shown in FIG. 1. The upward angle of each set of alignment stripes is evident from this figure.

The alignment stripes are affixed to the upper of each shoe and offset at a particular angle with respect to an imaginary vertical line running through and bisecting the length of each shoe. As discussed above, it is within the scope of the invention to allow for a great range in this angle, depending upon the difference in shoe width between the toe and heel regions. In other words, if the angle $\theta$ is ten degrees, it is approximately a ten-degree shift of each heel inward from a position where the shoes lay separated yet parallel in respect to the aforementioned vertical lengthwise line, (where the stripes of one shoe are thus not parallel with the stripes on the other shoe), to a position where the heels and inner toe portion of the shoes are touching, and the combined alignment stripes of each shoe now form extended horizontal lines, as in FIG. 2. However, because shoe widths and dimensions may vary, the invention does not limit the alignment stripes to a precise angle or a specific range of angles.

Once the golfer's feet have been brought together as in FIG. 2, the VAC 30 is created. As shown in FIG. 2, the alignment stripes create a vertical channel and afford the golfer an opportunity to line up the VAC 30 parallel to the already positioned clubface. In this fashion, the golfer now has a set of vertical and horizontal guidelines by which to align his or her feet parallel to the clubface, and thus, in turn, align the golfer's feet parallel to the originally chosen target line. Again, it is critical to note that the invention is effective by taking advantage of the steps normally taken by a golfer in preparing and lining up for a putt, or other type of golf shot. Although the invention may be utilized for any type of golf shot, whether it be driving, fairway shots, or the like, it is most effective when used as an alignment guide for putting since putting typically requires the golfer's feet to be close together, in a natural side-by-side manner. Finally, as these horizontal stripes provide a visual putting line image parallel to the original target line, the line can now be used to reinforce the correct "straight back, straight forward" putting stroke.

Referring now to FIG. 3, an alternate embodiment of the present invention is shown. A substantially vertical alignment stripe 34 connects one or more of the horizontal alignment stripes 24, 26. This vertical stripe 34 assists in the alignment process by providing the golfer with a visual vertical portion of the VAC 30. FIG. 4 illustrates the usefulness of vertical stripe 34 after the golfer's feet have been brought together. In FIG. 4, two horizontal alignment stripes are disposed upon each shoe instead of three. Vertical stripe 34 provides the golfer with a physical visual vertical alignment guide as opposed to the virtual or perceived Vertical Alignment Channel 30. This physical guide is a portion of the VAC 30 described earlier. VAC 30 therefore extends the vertical guide created by vertical stripes 34 onto the golf green.

Figure 6:
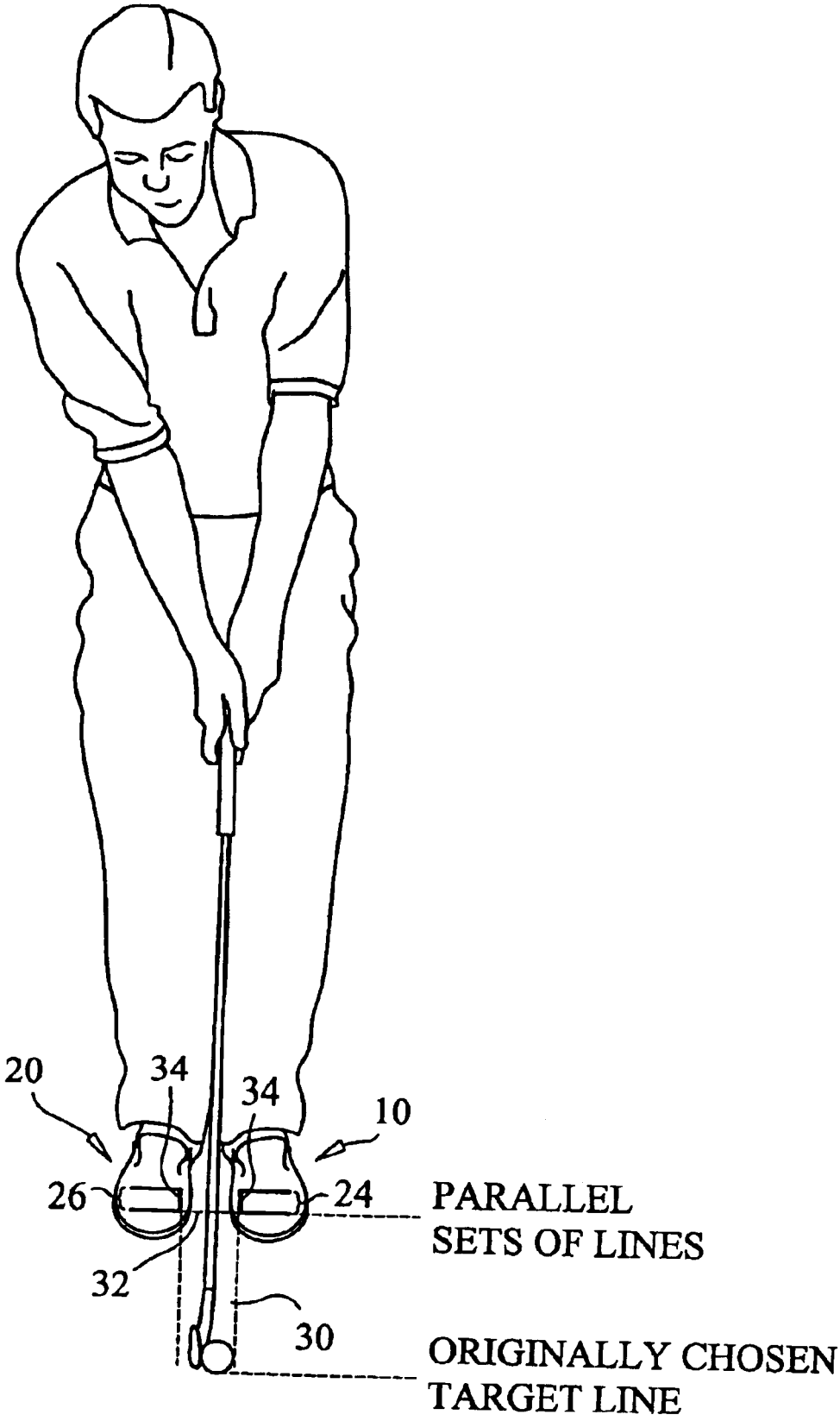
FIG. 6 is a front view of a golfer bringing his or her feet together to activate the present invention.

FIGS. 5 and 6 illustrate the present invention in use. In FIG. 5, a golfer approaches a golf ball in preparation for a shot. Left shoe 10 and right shoe 20 include two alignment stripes 24 and 26, respectively. A vertical alignment stripe 34 connects the horizontal alignment stripes on each shoe. In this position, the golfer is not yet ready to putt, and instead must bring his or her feet closer together to get into the proper alignment or "address" position unless they are already positioned correctly. Although the golfer's feet are pointed substantially forward, the alignment stripes 24 and 26 are skewed outward and the alignment system is not activated.

In FIG. 6, the golfer's feet are now in a side-by-side arrangement, and the golfer may now properly position his or her feet in relation to the already positioned clubface. The golfer glances down at his shoes and locates both the physical and the virtual Vertical Alignment Channel 30, which has now been created. The golfer is aided by the appearance of the vertical alignment stripe 34, which is part of VAC 30. The golfer may now position his or her feet in relation to the face of the golf club using the two imaginary lines (comprising VAC 30) that extend out from vertical stripe 34 on each shoe. The golfer's feet are now positioned correctly in order to properly strike the ball. Further, prior to swinging, the golfer may also glance down and make sure that the ensuing stroke follows the identical back and forth path in accordance with the horizontal guide created from the parallel arrangement of each of the alignment stripes on the left shoe with each of the corresponding alignment stripes on the right shoe.

Figure 7:
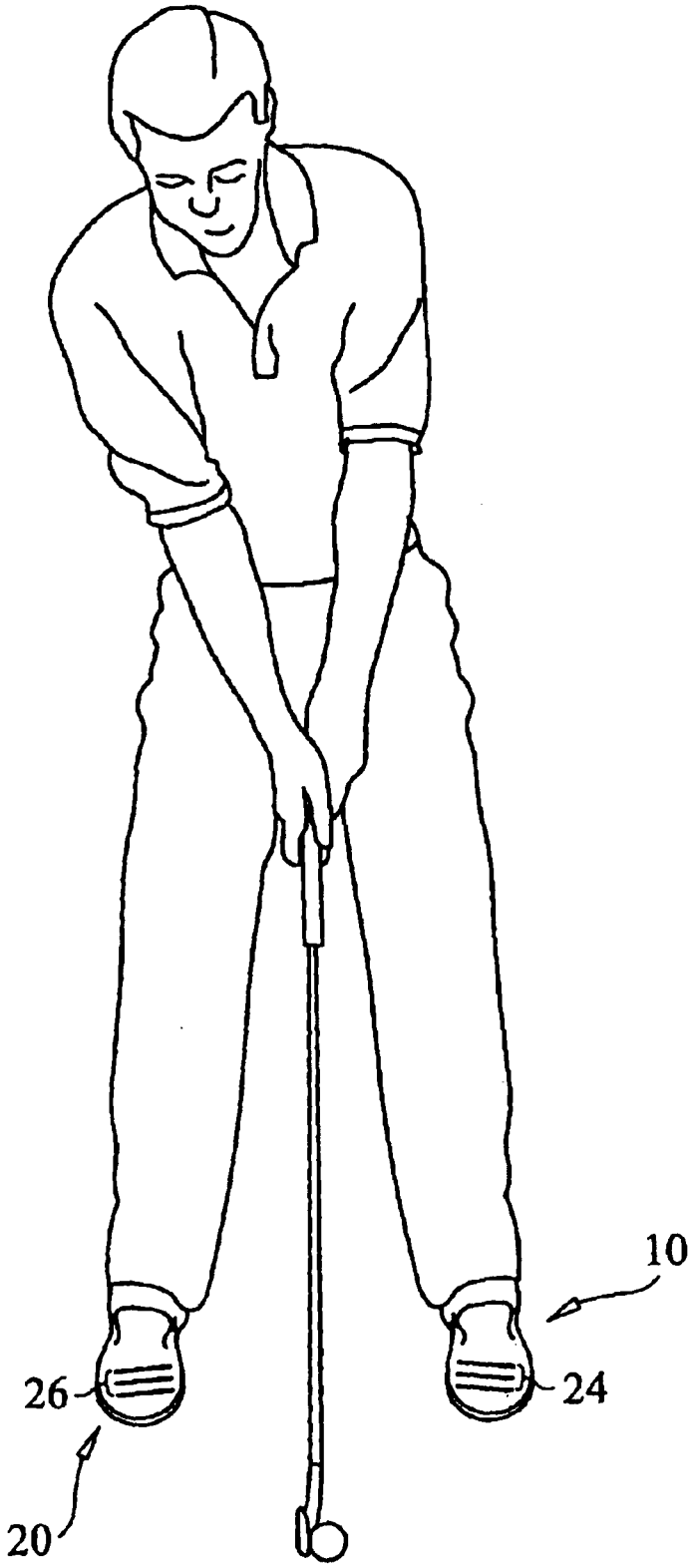
FIG. 7 is a front view of a golfer wearing an alternate embodiment of the golf shoes of the present invention approaching a ball prior to putting.
Figure 8:
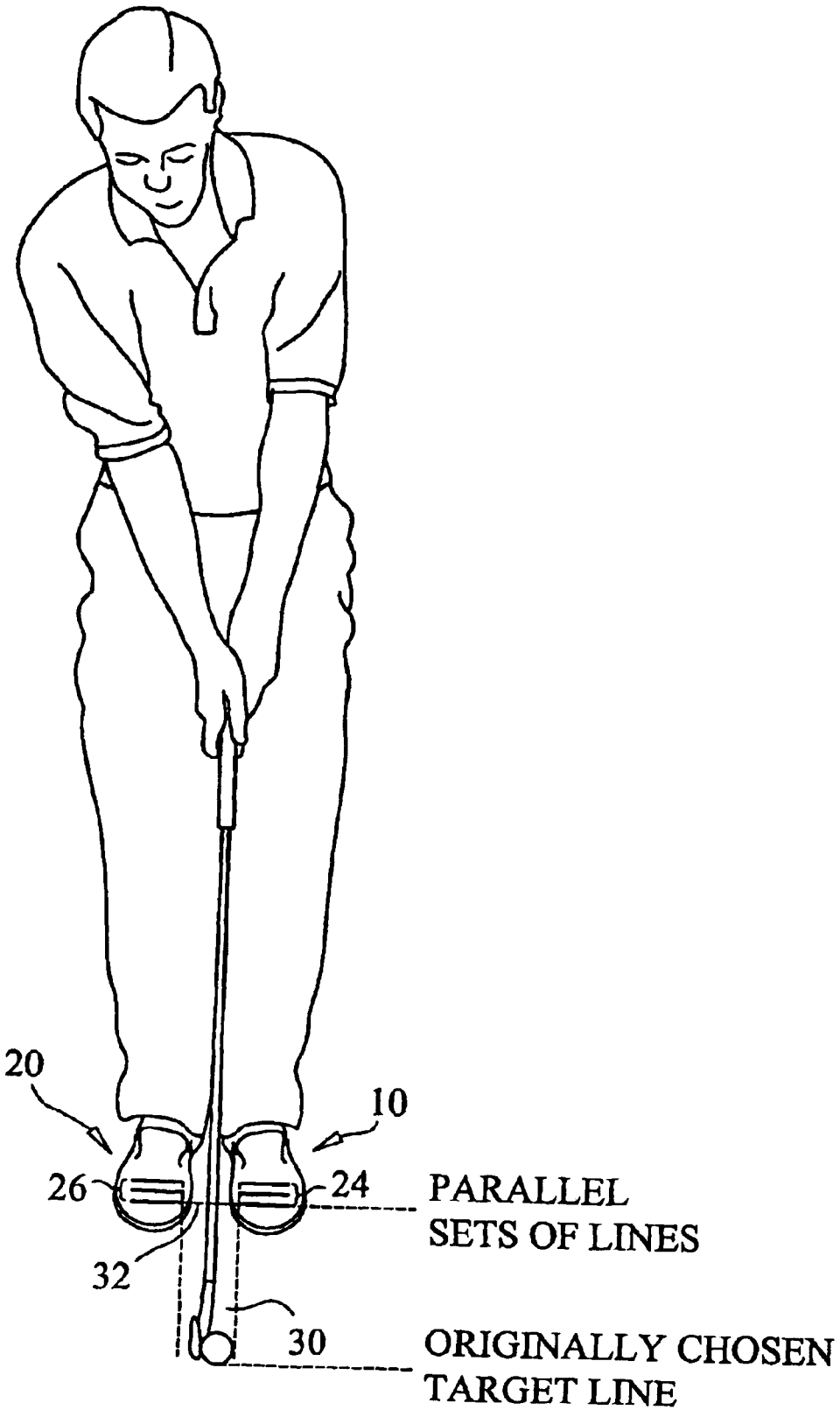
FIG. 8 is a front view of a golfer wearing an alternate embodiment of the golf shoes of the present invention after bringing his or her feet together to activate the present invention.

FIGS. 7 and 8 are identical to FIGS. 5 and 6 except for the absence of vertical alignment stripes 34. However, the same principals apply for aligning the golfer's feet prior to putting. In FIG. 8, VAC 30 is created upon the touching or close, side-by-side positioning of the shoes. The golfer then positions his or her feet (parallel) in relation to the already positioned clubface utilizing this "channel". Further, in the position shown in FIG. 8, the virtual horizontal guide, formed by the arrangement of corresponding alignment stripes on each shoe, appears, and the golfer would then attempt to swing the golf club parallel to the horizontal guideline thereby insuring the proper striking of the golf ball during the putt.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A golf shot alignment system comprising a left and a right shoe, each having a longitudinal axis and front and rear regions, wherein each said shoe includes alignment indicia disposed upon an upper surface thereof, such that when the front and rear regions of the left shoe are side-by-side with corresponding front and rear regions of the right shoe, the alignment indicia form a vertical alignment channel.

2. The golf alignment system of claim 1 wherein the alignment indicia are comprised of markings that are visually discernable from the shoes.

3. The golf shot alignment system of claim 2 wherein the markings are comprised of a color that is distinguishable from the color of each shoe.

4. The golf shot alignment system of claim 2 wherein the markings are affixed to the upper surface of each shoe via adhesive means.

5. The golf shot alignment system of claim 2 wherein the markings are painted on the upper surface of each shoe.

6. The golf shot alignment system of claim 2 wherein the markings are manufactured as an integral component of each shoe.

7. The golf shot alignment system of claim 2 wherein the markings are formed of raised stitching extending from the surface of the shoes.

8. The golf shot alignment system of claim 2 wherein the markings are formed by recesses within the shoes.

9. The golf shot alignment system of claim 2 wherein the markings are comprised of at least two alignment stripes disposed upon the upper surface of each shoe, each said alignment stripe having a transverse axis offset from the longitudinal axis of the shoe upon which it is disposed such that when the front and rear regions of the left shoe are side-by-side with corresponding front and rear regions of the right shoe, the inner edges of the alignment stripes on the left shoe become substantially parallel to the inner edges of the alignment stripes on the right shoe due to a wider width of a human's front foot region and a narrower width of a human's rear foot region thereby creating the vertical alignment channel extending forward from the aligned inner edges of the alignment stripes.

10. The golf alignment system of claim 9 wherein each shoe further comprises at least one substantially vertically aligned stripe connecting two or more said alignment stripes thereby visually displaying at least a portion of the vertical alignment channel.

11. The golf shot alignment system of claim 9 wherein when the front and rear regions of the left shoe are side-by-side with the corresponding front and rear regions of the right shoe, the longitudinal axis of each alignment stripe on the left shoe is substantially parallel to the longitudinal axis of a corresponding alignment stripe on the right shoe thereby creating at least one horizontal alignment guide line to provide the golfer with an additional golf shot alignment mechanism.

12. A pair of golf shoes used to assist a golfer in, aligning a golf swing, the golf shoes comprising:

a left and a right shoe each having a longitudinal axis and front and rear regions, wherein each said shoe includes alignment indicia disposed upon an upper surface thereof, the alignment indicia comprised of at least one alignment stripe, each said alignment stripe having a transverse axis offset from the longitudinal axis of the shoe upon which it is disposed such that when the front and rear regions of the left shoe are side-by-side with corresponding front and rear regions of the right shoe, the inner edges of the at least one alignment stripe on the left shoe become substantially parallel to the inner edges of the at least one alignment stripe on the right shoe due to a wider width of a human's front foot region and a narrower width of a human's rear foot region thereby creating a vertical alignment channel extending forward from the aligned inner edges of the alignment stripes.

13. The golf shoes of claim 12 wherein each said shoe further comprises at least one substantially vertically aligned stripe connecting two or more said alignment stripes thereby visually displaying at least a portion of the vertical alignment channel.

14. A method for assisting a golfer in aligning a golf swing comprising the steps of:

positioning a golfer's left and right shoes, wherein each of the golfer's shoes have a longitudinal axis and front and rear regions, and alignment indicia disposed upon an upper surface of each said shoe, the alignment indicia comprised of at least one alignment stripe, each said alignment stripe having a transverse axis offset from the longitudinal axis of the shoe upon which it is disposed; and aligning the golfer's shoes such that when the front and rear regions of the left shoe are side-by-side with corresponding front and rear regions of the right shoe, the inner edges of the alignment stripes on the left shoe become substantially parallel to the inner edges of the alignment stripes on the right shoe due to a wider width of a human's front foot region and a narrower width of a human's rear foot region thereby creating a vertical alignment channel extending forward from the aligned inner edges of the alignment stripes.

15. A method for assisting a golfer in aligning a golf swine, comprising the steps of:

positioning a golfer's left and right shoes in a first position wherein the golfer's feet are in a pre-shot orientation, each of the golfer's shoes having a longitudinal axis and front and rear regions, wherein each said shoe includes alignment indicia disposed upon an upper surface thereof, the alignment indicia comprised of at least one alignment stripe each having a transverse axis offset from the longitudinal axis of the shoe upon which it is disposed; and moving the golfer's feet together resulting in a second position wherein the front and rear regions of the left shoe are side-by-side with corresponding front and rear regions of the right shoe such that the inner edges of the alignment stripes on the left shoe become substantially parallel to the inner edges of the alignment stripes on the right shoe due to a wider width of a human's front foot region and a narrower width of a human's rear foot region thereby creating a vertical alignment channel.

16. The method of claim 15 wherein when the front and rear regions of the left shoe are side-by-side with corresponding front and rear regions of the right shoe, the longitudinal axis of each alignment stripe on the left shoe is substantially parallel to the longitudinal axis of a corresponding alignment stripe on the right shoe thereby creating at least one horizontal alignment guide line to provide the golfer with an additional golf shot alignment mechanism.

17. The method of claim 16 further comprising swinging the golf club along a path substantially parallel to the at least one horizontal alignment guide.

18. The golf shot alignment system of claim 2 wherein the markings are comprised of at least two alignment stripes disposed upon the upper surface of each shoe, each said alignment stripe having a transverse axis offset from the longitudinal axis of the shoe upon which it is disposed such that when the front and rear regions of the left shoe are side-by-side with the corresponding front and rear regions of the right shoe, the alignment stripes on the left shoe become substantially parallel to the alignment stripes on the right shoe due to a wider width of a human's front foot region and a narrower width of a human's rear foot region thereby creating the vertical alignment channel extending forward from the aligned inner edges of the alignment stripes.

19. A golf shot alignment system comprising a left and a right shoe, each having a longitudinal axis and front and rear regions, wherein each said shoe includes alignment indicia disposed upon an upper surface thereof, such that when the front region of the left shoe touches the front region of the right shoe and the rear region of the left shoe touches the rear region of the right shoe, the alignment indicia form a vertical alignment channel.

* * * * *